US009581941B2

(12) United States Patent
Egawa

(10) Patent No.: US 9,581,941 B2
(45) Date of Patent: Feb. 28, 2017

(54) BELT FOR ELECTROPHOTOGRAPHY AND PRODUCTION METHOD THEREFOR, AND ELECTROPHOTOGRAPHIC IMAGE FORMING APPARATUS

(71) Applicant: CANON KABUSHIKI KAISHA, Tokyo (JP)

(72) Inventor: Noriaki Egawa, Komae (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 353 days.

(21) Appl. No.: 14/263,324

(22) Filed: Apr. 28, 2014

(65) Prior Publication Data

US 2014/0227526 A1 Aug. 14, 2014

Related U.S. Application Data

(63) Continuation of application No. PCT/JP2013/007702, filed on Dec. 27, 2013.

(30) Foreign Application Priority Data

Jan. 4, 2013 (JP) ..... 2013-000192

(51) Int. Cl.
*G03G 15/16* (2006.01)

(52) U.S. Cl.
CPC .... *G03G 15/162* (2013.01); *G03G 2215/1623* (2013.01); *Y10T 428/31504* (2015.04)

(58) Field of Classification Search
None
See application file for complete search history.

(56) References Cited

U.S. PATENT DOCUMENTS

| | | | | |
|---|---|---|---|---|
| 7,546,075 | B2 | 6/2009 | Hirai et al. | |
| 8,445,071 | B2 | 5/2013 | Egawa | |
| 8,512,811 | B2 | 8/2013 | Egawa | |
| 2008/0138728 | A1* | 6/2008 | Sugino | G03G 5/0575 430/58.75 |
| 2009/0076219 | A1* | 3/2009 | Yamashita | C09D 11/03 525/55 |

FOREIGN PATENT DOCUMENTS

| | | | |
|---|---|---|---|
| JP | 2004-182382 | A | 7/2004 |
| JP | 2007-011117 | A | 1/2007 |
| JP | 2007-031625 | A | 2/2007 |
| JP | 2012-113197 | A | 6/2012 |

OTHER PUBLICATIONS

International Preliminary Report on Patentability in International Application No. PCT/JP2013/007702 (issued Jul. 7, 2015).
First Office Action in Chinese Application No. 201380069392.0 (Nov. 28, 2016).

* cited by examiner

*Primary Examiner* — Sheeba Ahmed
(74) *Attorney, Agent, or Firm* — Fitzpatrick, Cella, Harper & Scinto

(57) ABSTRACT

Provided is a belt for electrophotography which is capable of suppressing the occurrence of adhesion to other members and blocking and which is less liable to cause image defects due to a singular protrusion. The belt for electrophotography comprises a surface layer which comprises heteroaggregate including an inorganic oxide particle having an average primary particle diameter of from 10 to 30 nm and an electroconductive metal oxide particle having an average primary particle diameter of from 5 to 40 nm, and a ten-point average roughness Rzjis of a surface of the surface layer satisfies a relationship: 0.3 μm≤Rzjis≤0.7 μm.

6 Claims, 3 Drawing Sheets

BELT FOR ELECTROPHOTOGRAPHY AND PRODUCTION METHOD THEREFOR, AND ELECTROPHOTOGRAPHIC IMAGE FORMING APPARATUS

CROSS-REFERENCE TO RELATED APPLICATIONS

This application is a continuation of International Application No. PCT/JP2013/007702, filed Dec. 27, 2013, which claims the benefit of Japanese Patent Application No. 2013-000192, filed Jan. 4, 2013.

BACKGROUND OF THE INVENTION

Field of the Invention

The present invention relates to a belt for electrophotography such as a conveyance transfer belt or an intermediate transfer belt to be used for, for example, an electrophotographic image forming apparatus such as a copying machine or a printer.

Description of the Related Art

In an electrophotographic image forming apparatus, a belt for electrophotography serving as a conveyance transfer belt for conveying a transfer material or as an intermediate transfer belt for temporarily transferring and holding a toner image is used. The belt for electrophotography comes into contact with and slides on other members in the electrophotographic image forming apparatus. Therefore, in the case where the surface of the belt for electrophotography is excessively smooth, adhesion to the other members or a blocking phenomenon is caused in some cases.

In particular, when a photosensitive drum and the surface of the belt for electrophotography are liable to adhere to each other, the running stability of the photosensitive drum and the belt for electrophotography may be impaired in some cases. Further, when a cleaning blade and the surface of the belt for electrophotography are liable to adhere to each other, blade curling or cleaning failure occurs in some cases. In order to solve the above-mentioned problems, hitherto, an attempt has been made to roughen the surface of a belt for electrophotography (Japanese Patent Application Laid-Open No. 2004-182382).

Japanese Patent Application Laid-Open No. 2007-31625 proposes, as a method of roughening the surface of a belt for electrophotography, a method involving causing a surface layer to contain particles each having a particle diameter of about 0.1 to 3 μm to form a protruded portion derived from the particles on the surface of the surface layer. However, a singularly large protrusion may be formed on the surface of the surface layer owing to agglomeration of the particles contained in the surface layer and the like. In the case of using the belt for electrophotography having such protrusion as an intermediate transfer belt, the transfer of a toner image from a photosensitive member (hereinafter sometimes referred to as "primary transfer"), or the transfer of a toner image from the intermediate transfer belt to paper or the like (hereinafter sometimes referred to as "secondary transfer") are inhibited, which may cause defects in an electrophotographic image.

SUMMARY OF THE INVENTION

In order to solve the above-mentioned problems, the inventors of the present invention tried using particles each having a small particle diameter of about 0.1 μm as particles for roughening the surface of a surface layer. As a result, the surface of a belt for electrophotography was not necessarily roughened sufficiently. In the case of using such belt for electrophotography for a long period of time, the surface of the belt for electrophotography is smoothened, and the adhesion of the belt for electrophotography to other members or blocking phenomenon as described above occur in some cases.

In view of the foregoing, the present invention is directed to providing a belt for electrophotography which is capable of suppressing the occurrence of the adhesion to other members and blocking and which is less liable to cause image defects due to a singular protrusion. Further, the present invention is directed to providing an electrophotographic image forming apparatus capable of stably providing high-quality electrophotographic images.

According to one aspect of the present invention, there is provided a belt for electrophotography, comprising: a base layer; and a surface layer provided on the base layer, or comprising: a base layer; an elastic layer provided on the base layer; and a surface layer provided on the elastic layer, wherein: the surface layer comprises heteroaggregate comprising an inorganic oxide particle having an average primary particle diameter of from 10 to 30 nm, and an electroconductive metal oxide particle having an average primary particle diameter of from 5 to 40 nm, the electroconductive metal oxide particle being different from the inorganic oxide particle; and wherein: a ten-point average roughness Rzjis of a surface of the surface layer satisfies a relationship: $0.3\ \mu m \leq Rzjis \leq 0.7\ \mu m$.

According to another aspect of the present invention, there is provided a production method for a belt for electrophotography, comprising: a base layer; and a surface layer provided on the base layer or comprising: a base layer; an elastic layer provided on the base layer; and a surface layer provided on the elastic layer, the production method comprising: applying a curable composition containing the following components (a) to (d) on the base layer or on the elastic layer each containing the following component (e); and curing the curable composition and forming the surface layer, (a) an alkyl group-modified inorganic oxide particle having an average primary particle diameter of from 10 to 30 nm;
(b) an electroconductive metal oxide particle having an average primary particle diameter of from 5 to 40 nm treated with an alkylamine;
(c) an acrylic monomer;
(d) 2-butanone or 4-methyl-2-pentanone; and
(e) a perfluoroalkyl sulfonic acid alkali metal salt or a perfluoroalkyl sulfonimide alkali metal salt.

According to further aspect of the present invention, there is provided an electrophotographic apparatus, comprising the above-described belt for electrophotography as an intermediate transfer belt.

According to the present invention, there is provided the belt for electrophotography which includes a base layer and a surface layer or which includes a base layer, an elastic layer and a surface layer, and in which a singular point (seediness) is less liable to occur and adhesion is reduced in a long-term use. Further, in the case of using the belt for electrophotography for an image forming apparatus or the like, the adhesion to other members which are in contact with the belt, in particular, a photosensitive drum and a cleaning blade is reduced. Therefore, effects of, for example, ensuring the running stability of the photosensitive drum and the belt for electrophotography and preventing blade curling are obtained, and image defects caused by a singular point (seediness) can be reduced.

Further features of the present invention will become apparent from the following description of exemplary embodiments with reference to the attached drawings.

DESCRIPTION OF THE EMBODIMENTS

Figure 1:
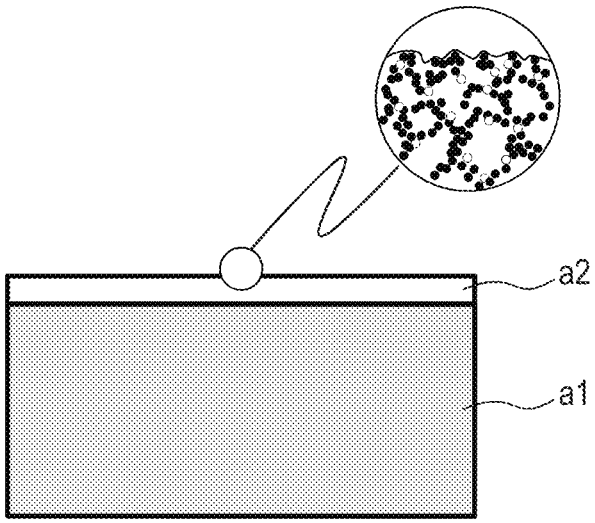
FIG. 1 is a schematic sectional view of a belt for electrophotography according to the present invention.

Preferred embodiments of the present invention will now be described in detail in accordance with the accompanying drawings.

The inventors of the present invention have been made extensive studies in order to achieve the above-mentioned objects.

As a result, the inventors have found that, in the following belt for electrophotography, a singular point (seediness) is less liable to occur and adhesion is reduced in a long-term use. The belt for electrophotography includes a base layer and a surface layer provided on the base layer or includes a base layer, an elastic layer provided on the base layer and a surface layer provided on the elastic layer, in which the surface layer comprises heteroaggregate containing inorganic oxide particles each having an average primary particle diameter of from 10 to 30 nm, and conductive metal oxide particles each having an average primary particle diameter of from 5 to 40 nm, the conductive metal oxide particles being different from the inorganic oxide particles, and a ten-point average roughness (hereinafter sometimes referred to as "Rzjis") of a surface of the surface layer satisfies a relationship: 0.3 μm≤Rzzjis≤0.7 μm.

Hereinafter, a belt for electrophotography according to an embodiment of the present invention is described in detail. Note that the present invention is not limited to the following embodiment.

Roughening of the surface of the surface layer according to the present invention so as to obtain an Rzjis of 0.3 μm or more and 0.7 μm or less is achieved by forming a protruded portion derived from the heteroaggregate of inorganic oxide particles each having an average primary particle diameter of 10 to 30 μm and conductive metal oxide particles each having an average primary particle diameter of 5 to 40 μm on the surface of the surface layer as described above.

In general, it is difficult to form a roughened surface having an Rzjis of 0.3 μm or more and 0.7 μm or less even by causing the surface layer to contain the particles each having an average primary particle diameter as described.

On the other hand, in the case of causing the surface layer to contain particles each having an average primary particle diameter capable of obtaining an Rzjis in the above-mentioned range, it has been difficult to avoid the formation of a singular protrusion due to the agglomeration of the particles.

In view of foregoing, the inventors of the present invention formed a protruded portion on the surface of the surface layer with an heteroaggregate of particles each having an average primary particle diameter which itself is too small for roughening in the above-mentioned numerical value range of an Rzjis. Thus, the inventors of the present invention have achieved stable roughening while avoiding the formation of a singular protrusion on the surface of the surface layer.

The heteroaggregation of inorganic oxide fine particles and conductive metal oxide particles different from the inorganic oxide fine particles can be formed rapidly in the presence of alkali metal ions.

In order to form the heteroaggregation of the inorganic oxide particles and the conductive metal oxide particles rapidly during a period of time from the time immediately after the application of a curable composition to the base layer of the belt for electrophotography to the time when a solvent of a coat of the curable composition is completely volatilized, it is effective to cause the base layer of the belt for electrophotography to contain alkali metal ions with molecular form which can migrate to the inside of the curable composition.

The alkali metal ions can be allowed to migrate to the curable composition side by using 2-butanone or 4-methyl-2-pentanone as the solvent of the curable composition and causing the base layer of the belt for electrophotography to contain a perfluoroalkyl sulfonic acid alkali metal salt or a perfluoroalkyl sulfonimide alkali metal salt.

A mechanism for forming the heteroaggregation is as follows.

(1) Curable Composition Before Application:

The electrification charges (zeta potentials) of the inorganic oxide particles and the conductive metal oxide particles in the curable composition are minus, and both the particles keep a stable dispersed state.

(2) Curable Composition Applied to Base Layer of Belt for Electrophotography (Before Complete Volatilization of Solvent of Coat for Electrophotography):

Owing to the migration of the alkali metal ions contained in the base layer of the belt for electrophotography to the curable composition, the concentration of the alkali metal ions in the coat increases, and owing to the volatilization of the solvent, the concentration of the alkali metal ions in the coat further increases.

(3) Coordination and adsorption of the alkali metal ions with respect to the conductive metal oxide particles invert the electrification charge (zeta potential) of the conductive metal oxide particles. The conductive metal oxide particles are positively charged, and the inorganic oxide particles are negatively charged, with the result that a remarkable heteroaggregation of both the particles is formed.

(4) The surface of the belt for electrophotography is roughened owing to the heteroaggregation formed in the above-mentioned (3).

It is considered that, in the process of the above-mentioned (3), the coordination and adsorption of the alkali metal ions occur on both the conductive metal oxide particles and the inorganic oxide particles. However, the electrification charge (zeta potential) of the conductive metal oxide particles is easily inverted, compared to the inorganic oxide particles. The above-mentioned phenomenon is allowed to occur through use of this property.

Further, when the zeta potential of each of slurry containing inorganic oxide particles and slurry containing conductive metal oxide particles used herein as described later is measured, it is found that the zeta potential in the absence of alkali metal ions is minus for both the conductive metal oxide particles and the inorganic oxide particles. On the other hand, the zeta potential in the presence of alkali metal ions is plus for the conductive metal oxide particles and minus for the inorganic oxide particles.

The belt for electrophotography according to the present invention is described.

FIG. 1 is a conceptual sectional view of the belt for electrophotography of the present invention. The belt for electrophotography includes a seamless belt base layer for electrophotography a1 and a surface layer a2 obtained by laminating a curable composition on the base layer.

The thickness of the base layer is generally 10 μm or more and 500 μm or less, in particular, 30 μm or more and 150 μm or less. It is preferred that the thickness of the surface layer be 0.05 μm or more and 20 μm or less, in particular, about 0.1 μm to 5 μm. Note that the belt for electrophotography may further include another layer between the base layer and the surface layer or on the surface layer.

<<Curable Composition>>

The curable composition for forming the surface layer of the present invention is described.

<Constituent Components of Curable Composition>

Constituent components of the curable composition for forming the surface layer of the present invention are described below.

(a) Alkyl Group-Modified Inorganic Oxide Particles Each Having Average Primary Particle Diameter of 10 to 30 nm:

It is preferred that the average primary particle diameter of each of the inorganic oxide particles to be used in the present invention be 10 to 30 nm. When the average primary particle diameter is more than 30 nm, there is a possibility that the number of singular points (seediness) on the surface layer may increase. Further, it is preferred that the surface of each of the inorganic oxide particles be modified with an alkyl group through use of a silane coupling agent so that the inorganic oxide particles are dispersed stably in an organic solvent and negatively charged. As the inorganic oxide particles, silica particles are most preferred from the viewpoint that the inorganic oxide particles are dispersed stably in an organic solvent and negatively charged. Silica particles obtained by hydrolysis or the like of tetraethoxysilane can be subjected to alkyl treatment with a silane coupling agent. Further, for example, commercially available products such as Snowtex MEK-ST manufactured by Nissan Chemical Industries, Ltd. and Oscal manufactured by JGC Catalysts and Chemicals Ltd. can be used.

(b) Conductive Metal Oxide Particles Each Having Average Primary Particle Diameter of 5 to 40 nm Treated with Alkylamine:

There is a case where semi-conductivity is required of a belt for electrophotography, and hence it is preferred to use conductive particles as particles. It is preferred that the average primary particle diameter of each of the conductive metal oxide particles to be used in the present invention be 5 to 40 nm. When the average primary particle diameter is more than 40 nm, there is a possibility that the number of singular points (seediness) on the surface layer may increase.

Further, it is preferred that the conductive metal oxide particles be treated with an alkylamine so that the conductive metal oxide particles are stably dispersed in an organic solvent and negatively charged, and the electrification charge of the conductive metal oxide particles is inverted plus by the adsorption and coordination of alkali metal ions.

By dispersing a mixture containing conductive metal oxide particles, 2-butanone, and tri-n-butylamine with a bead mill or the like, the conductive metal oxide particles can be treated with the alkylamine. Zinc antimonate particles are most preferred as the conductive metal oxide particles from the viewpoints of stably dispersing the conductive metal oxide particles in an organic solvent, negatively charging the conductive metal oxide particles, and inverting the electrification charge of the conductive metal oxide particles to be plus by the adsorption and coordination of alkali metal ions. Further, for example, a commercially available product such as CELNAX CX-Z400K manufactured by Nissan Chemical Industries, Ltd. can be used.

(c) Acrylic Monomer;

It is preferred that an acrylic monomer be contained as a matrix resin for the curable composition forming the surface layer. The acrylic monomer to be used in the present invention is not particularly limited, and a polyfunctional acrylic monomer is preferred from the viewpoints of rubbing resistance and hardness. Suitable examples thereof include pentaerythritol tri(meth)acrylate and pentaerythritol tetra (meth)acrylate, trimethylolpropane tri(meth)acrylate, EO-modified trimethylolpropane tri(meth)acrylate, PO-modified trimethylolpropane tri(meth)acrylate, dipentaerythritol penta(meth)acrylate and dipentaerythritol hexa(meth)acrylate, and isocyanuric acid EO-modified di(meth)acrylate and isocyanuric acid EO-modified tri(meth)acrylate. In particular, it is preferred that dipentaerythritol penta(meth)acrylate and dipentaerythritol hexa(meth)acrylate be contained.

Note that multiple acrylic monomers may be used for curing shrinkage adjustment or viscosity adjustment.

(d) 2-Butanone or 4-methyl-2-pentanone;

It is preferred that 2-butanone or 4-methyl-2-pentanone be used as a solvent for stably dispersing or dissolving the components (a), (b), and (c) described above as well as a component (e) described later.

Note that multiple solvents other than the above-mentioned solvent may be added for evaporation rate adjustment or viscosity adjustment.

Specific examples thereof may include: alcohols such as methanol, ethanol, isopropanol, butanol, and octanol; ketones such as acetone and cyclohexanone; esters such as ethyl acetate, butyl acetate, ethyl lactate, γ-butyrolactone, propylene glycol monomethyl ether acetate, and propylene glycol monoethyl ether acetate; ethers such as ethylene glycol monomethyl ether and diethylene glycol monobutyl ether; aromatic hydrocarbons such as benzene, toluene, and xylene; and amides such as dimethylformamide, dimethylacetamide, and N-methylpyrrolidone.

Of those, methyl isobutyl ketone, methyl ethyl ketone, cyclohexanone, propylene glycol monomethyl ether acetate, propylene glycol monoethyl ether acetate, toluene, xylene, or the like is preferred.

(e) Perfluoroalkyl Sulfonic Acid Alkali Metal Salt or Perfluoroalkyl Sulfonimide Alkali Metal Salt;

In the present invention, the alkali metal salt is incorporated into the base layer, followed by application of the curable composition, and thus the alkali metal salt is caused to migrate to the curable composition side in drying. The component (e) may be supplementarily added to the curable composition in such a range that the dispersibility of the curable composition is not impaired.

It is preferred that a perfluoroalkyl sulfonic acid alkali metal salt or a perfluoroalkyl sulfonimide alkali metal salt be used as an alkali metal ion-containing substance soluble in an organic solvent, in particular, 2-butanone or 4-methyl-2-pentanone as the component (d).

Specific examples thereof include potassium perfluorobutanesulfonate (potassium nonafluorobutanesulfonate; $C_4F_9SO_3K$) and potassium N,N-bis(nonafluorobutanesulfonyl)imide $(C_4F_9SO_2)_2NK$), which are commercially available as "KFBS" and "EF-N442", respectively (each of which is manufactured by Mitsubishi Materials Electronic Chemicals Co., Ltd.).

The following components may be blended into the curable composition as required.

Radical Polymerization Initiator;

As a radical polymerization initiator, there may be given, for example: a compound capable of thermally generating an active radical species (thermal polymerization initiator); and a compound capable of generating an active radical species by radiation (light) irradiation (radiation (photo) polymerization initiator).

The radiation (photo) polymerization initiator is not particularly limited as long as the radiation (photo) polymerization initiator can initiate polymerization by generating a radical through decomposition by light irradiation. Examples thereof may include acetophenone, acetophenone benzyl ketal, 1-hydroxycyclohexyl phenyl ketone, 2,2-dimethoxy-1,2-diphenylethane-1-one, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, benzoin propyl ether, benzoin ethyl ether, benzyl dimethyl ketal, 1-(4-isopropylphenyl)-2-hydroxy-2-methylpropane-1-one, 2-hydroxy-2-methyl-1-phenylpropane-1-one, thioxanthone, diethylthioxanthone, 2-isopropylthioxanthone, 2-chlorothioxanthone, 2-methyl-1-[4-(methylthio)phenyl]-2-morpholino-propane-1-one, 2-benzyl-2-dimethylamino-1-(4-morpholinophenyl)-butanone-1,4-(2-hydroxyethoxy) phenyl-(2-hydroxy-2-propyl) ketone, 2,4,6-trimethylbenzoyldiphenylphosphine oxide, bis-(2,6-dimethoxybenzoyl)-2,4,4-trimethylpentylphosphine oxide, and oligo(2-hydroxy-2-methyl-1-(4-(1-methylvinyl)phenyl) propanone).

The blending amount of the radial polymerization initiator to be used, as required, in the present invention is preferably 0.01 to 10 parts by mass, more preferably 0.1 to 5 parts by mass with respect to 100 parts by mass of a (meth)acrylate compound. When the blending amount is 0.01 part by mass, the hardness of a resultant cured substance becomes insufficient in some cases, and when the blending amount is more than 10 parts by mass, the inside (lower layer) of a resultant cured substance may not be cured completely.

Other

Any other component may be added to the curable composition as required as long as the effect of the present invention is not impaired. For example, the following components may be blended: a polymerization inhibitor, a polymerization initiation aid, a leveling agent, a wettability improving agent, a surfactant, a plasticizer, a UV absorber, an antioxidant, an antistatic agent, an inorganic filler, and a pigment.

<Production Method for Curable Composition>

A production method for the curable composition is not particularly limited. However, the curable composition contains the component (a) and the component (b), which are particulate substances, and the component (c), which tends to have high viscosity, and hence the curable composition is preferably produced as follows. Slurry obtained by dispersing the component (a) in a solvent, slurry obtained by dispersing the component (b) in a solvent, and a solution obtained by dissolving the component (c) in a solvent are prepared in advance, and are put in a container equipped with a stirrer together with the component (d), the component (e), a polymerization initiator, and other components in blending ratios described later. The mixture is stirred at room temperature for 30 minutes to obtain the curable composition.

<Application Method>

For example, the following general application methods may be given as an application method of applying the curable composition to the base layer of the belt for electrophotography to form the surface layer: dip coating, spray coating, flow coating, shower coating, roll coating, and spin coating.

<Curing Method>

The curable composition of the present invention can be cured with heat or a radiation (light, an electron beam, etc.). The radiation is not particularly limited as long as it is an active radiation capable of imparting energy which can generate a polymerization initiating species, and the radiation widely includes an α-ray, a γ-ray, an X-ray, ultraviolet light (UV), visible light, an electron beam, and the like. Of those, ultraviolet light and an electron beam are preferred, and ultraviolet light is particularly preferred from the viewpoints of curing sensitivity and availability of an apparatus.

<<Belt for Electrophotography>>

The belt for electrophotography according to the present invention is described.

The belt for electrophotography is formed of multiple layers, and its surface layer can be formed through use of the above-mentioned curable composition. Embodiments of a two-layered belt including a base layer and a surface layer and a three-layered belt including a base layer, an elastic layer, and a surface layer are described below.

<<Two-Layered Belt>>>

<<Base Layer>>

The base layer to be used for the belt for electrophotography having a two-layered configuration according to the present invention is described.

<Constituent Components of Base Layer>>

Constituent components of the base layer to be used for the belt for electrophotography of the present invention are described below.

(e) Perfluoroalkyl Sulfonic Acid Alkali Metal Salt or Perfluoroalkyl Sulfonimide Alkali Metal Salt;

In the present invention, it is preferred that the alkali metal salt be incorporated into the base layer, followed by application of the curable composition, and thus the alkali metal salt be caused to migrate to the curable composition side in drying. Therefore, it is preferred that, as an alkali metal ion-containing substance soluble in an organic solvent in the curable composition, in particular, 2-butanone or 4-methyl-2-pentanone as the component (d), at least one selected from a perfluoroalkyl sulfonic acid alkali metal salt and a perfluoroalkyl sulfonimide alkali metal salt be incorporated into the base layer.

As described above, specific examples of the perfluoroalkyl sulfonic acid alkali metal salt and the perfluoroalkyl sulfonimide alkali metal salt may include potassium perfluorobutanesulfonate (potassium nonafluorobutanesulfonate; $C_4F_9SO_3K$) and potassium N,N-bis(nonafluorobutanesulfonyl) imide $(C_4F_9SO_2)_2NK$).

(f) Resin Composition;

A resin composition to be used for forming the base layer is not particularly limited as long as the resin composition can contain the component (e) and the component (e) can migrate to the curable composition side, and any of various resins may be used. Specific examples thereof include resins such as polyimide (PI), polyamide imide (PAI), polypropylene (PP), polyethylene (PE), polyamide (PA), polylactic acid (PLLA), polyethylene terephthalate (PET), polyethylene naphthalate (PEN), polyphenylene sulfide (PPS), polyether ether ketone (PEEK), polycarbonate (PC), and a fluororesin (such as PVdF). In addition, a blended resin thereof is also suitably used. In particular, polyethylene naphthalate (PEN) is preferred.

As other components of the resin composition, there may be given, for example, an ion conductive agent (such as a polymeric ionic conductive agent or a surfactant), an electroconductive polymer, an antioxidant (such as a hindered phenol-based antioxidant, phosphorus-based antioxidant or sulfur-based antioxidant), a UV absorber, an organic pigment, an inorganic pigment, a pH regulating agent, a cross-linking agent, a compatibilizer, a release agent (such as a silicone-based release agent or fluorine-based release agent), a coupling agent, a lubricant, an insulating filler (such as zinc oxide, barium sulfate, calcium sulfate, barium titanate, potassium titanate, strontium titanate, titanium oxide, magnesium oxide, magnesium hydroxide, aluminum hydroxide, talc, mica, clay, kaolin, hydrotalcite, silica, alumina, ferrite, calcium carbonate, barium carbonate, nickel carbonate, glass powder, quartz powder, a glass fiber, an alumina fiber, a potassium titanate fiber, or a fine particle of a thermosetting resin), an electroconductive filler (such as carbon black, a carbon fiber, conductive titanium oxide, conductive tin oxide, or conductive mica), and an ionic liquid. One kind of those components may be used alone or two or more kinds thereof may be used in combination.

<Production Method for Base Layer>

A production method for the base layer is not particularly limited, and molding methods suitable for various resins may be used. Examples thereof include extrusion molding, inflation molding, blow molding, and centrifugal molding.

In Examples and Comparative Examples described later, the base layer was obtained by blow molding.

First, the resin materials described below were thermally melted and kneaded in blending ratios described later through use of a biaxial extruder (trade name: TEX30α, manufactured by The Japan Steel Works, Ltd.) to prepare a thermoplastic resin composition. The thermal melting and kneading temperature was adjusted so as to fall within the range of 260° C. or more to 280° C. or less, and the thermal melting and kneading time was set to about 3 to 5 minutes. The obtained thermoplastic resin composition was pelleted and dried at a temperature of 140° C. for 6 hours. Then, the dried pellet-shaped thermoplastic resin composition was supplied to an injection molding machine (trade name: SE180D, manufactured by Sumitomo Heavy Industries, Ltd.). Then, the thermoplastic resin composition was subjected to injection molding with a mold adjusted to a temperature of 30° C., with a cylinder setting temperature being 295° C., to obtain a preform. The obtained preform has a test tube shape having an outer diameter of 20 mm, an inner diameter of 18 mm, and a length of 150 mm.

Resin Material

PEN: polyethylene terephthalate (trade name: TR-8550, manufactured by Teijin Chemicals Ltd.)

PEEA: polyether ester amide (trade name: PELESTAT NC6321, manufactured by Sanyo Chemical Industries, Ltd.)

Component (e): perfluoroalkyl sulfonic acid alkali metal salt or perfluoroalkyl sulfonimide alkali metal salt CB1: carbon black (trade name: MA-100, manufactured by Mitsubishi Chemical Corporation)

Figure 2:
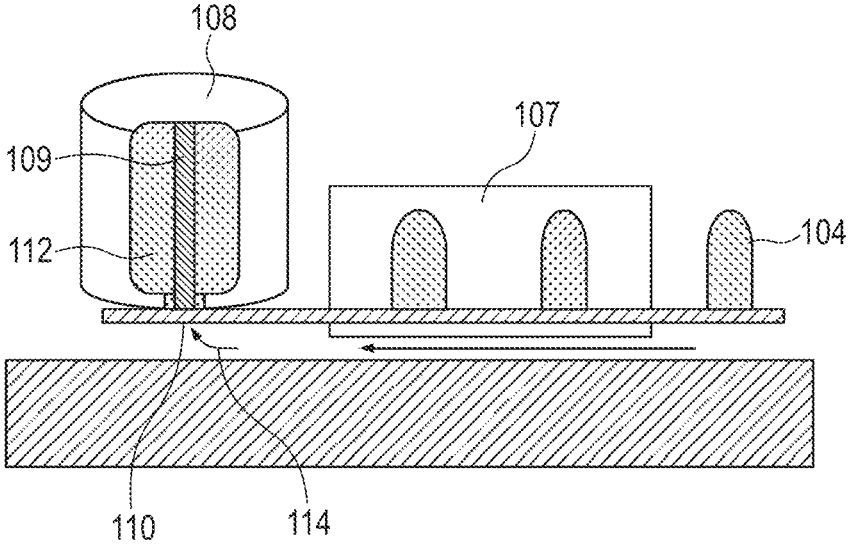
FIG. 2 is a schematic view of a stretch blow molding machine to be used for producing the belt for electrophotography according to the present invention.

Next, the above-mentioned preform is biaxially stretched through use of a biaxial stretching machine (stretch blow molding machine) illustrated in FIG. 2. Before biaxial stretching, a preform 104 was placed in a heating unit 107 equipped with a non-contact type heater (not shown) for heating an outer wall and an inner wall of the preform 104 and was heated with the heating heater so that an outer surface temperature of the preform reached 120° C.

Then, the heated preform 104 was placed in a blow mold 108 with a mold temperature being kept at 30° C. and was stretched in an axial direction through use of a stretching rod 109. Concurrently, air 114 adjusted to a temperature of 23° C. was introduced into the preform from a blow air injection portion 110 to stretch the preform 104 in a radial direction. Thus, a bottle-shaped molding 112 was obtained.

Then, a body portion of the obtained bottle-shaped molding 112 was cut to obtain a base layer for a seamless conductive belt. The thickness of the base layer for an electroconductive belt was 70 μm. The surface resistivity of the base layer was $1.0\times10^{11}\Omega/\square$.

<<Production Method for Surface Layer>>

A production method for the surface layer is not particularly limited as described in the above-mentioned section of the application method. In Examples and Comparative Examples described later, dip coating was used.

The base layer obtained by the blow molding was fitted around an outer circumference of a cylindrical mold, and ends thereof were sealed. Then, the base layer was soaked in a container filled with a curable composition together with the mold. The base layer was pulled up so that the relative speed of the liquid surface of the curable composition and the base layer became a predetermined speed, with the result that a coat of the curable composition was formed on the surface of the base layer. A pull-up speed (relative speed of the liquid surface of the curable composition and the base layer), a solvent ratio of the curable composition, and the like are adjusted depending on the intended film thickness.

In Examples and Comparative Examples described later, the pull-up speed was adjusted to 10 to 50 mm/sec, with the result that the film thickness of the surface layer was about 3 μm. The curable composition was prepared in a composition ratio described later. After the coat was formed, the resultant was dried in an environment of 23° C. under a vacuum state for 1 minute. The drying temperature and drying time are appropriately adjusted based on a solvent kind, a solvent ratio, film thickness, and the like. Then, the coat was cured by being irradiated with ultraviolet light until an accumulated light quantity reached 600 mJ/cm$^2$ through use of a UV irradiator (trade name: UE06/81-3, manufactured by Eye Graphics Co., Ltd.). The cross-section of the obtained surface layer was observed with an electron microscope, and it was found that the thickness of the surface layer was 3 μm.

<<<Three-Layered Belt>>>

<<Base Layer>>

The base layer to be used for the three-layered belt is described.

(f) Resin Composition;

The resin composition to be used for forming the base layer is not particularly limited, and any of various resins may be used. Specific examples thereof include resins such as polyimide (PI), polyamide imide (PAI), polypropylene (PP), polyethylene (PE), polyamide (PA), polylactic acid (PLLA), polyethylene terephthalate (PET), polyethylene naphthalate (PEN), polyphenylene sulfide (PPS), polyether ether ketone (PEEK), polycarbonate (PC), and a fluororesin (such as PVdF). In addition, a blended resin thereof is also suitably used.

As other components of the resin composition, there may be given, for example, an ion conductive agent (such as a polymeric ionic conductive agent or a surfactant), an electroconductive polymer, an antioxidant (such as a hindered phenol-based antioxidant, phosphorus-based antioxidant or sulfur-based antioxidant), a UV absorber, an organic pigment, an inorganic pigment, a pH regulating agent, a cross-linking agent, a compatibilizer, a release agent (such as a silicone-based release agent or fluorine-based release agent), a coupling agent, a lubricant, an insulating filler (such as zinc oxide, barium sulfate, calcium sulfate, barium titanate, potassium titanate, strontium titanate, titanium oxide, magnesium oxide, magnesium hydroxide, aluminum hydroxide, talc, mica, clay, kaolin, hydrotalcite, silica, alumina, ferrite, calcium carbonate, barium carbonate, nickel carbonate, glass powder, quartz powder, a glass fiber, an alumina fiber, a potassium titanate fiber, or a fine particle of a thermosetting resin), an electroconductive filler (such as carbon black, a carbon fiber, conductive titanium oxide, conductive tin oxide, or conductive mica), and an ionic liquid. One kind of those components may be used alone or two or more kinds thereof may be used in combination.

<Production Method for Base Layer>

A production method for the base layer is not particularly limited, and molding methods suitable for various resins may be used. Examples thereof include extrusion molding, inflation molding, blow molding, and centrifugal molding.

In Examples and Comparative Examples described later, the base layer was obtained by extrusion molding.

First, the resin materials described below were thermally melted and kneaded in blending ratios described later through use of a biaxial extruder (trade name: TEX30α, manufactured by The Japan Steel Works, Ltd.) to prepare a thermoplastic resin composition. The thermal melting and kneading temperature was adjusted so as to fall within the range of 350° C. or more to 380° C. or less. The obtained thermoplastic resin composition was pelleted.

Then, the pellet-shaped thermoplastic resin composition was supplied to a uniaxial screw extruder (trade name: GT40, manufactured by PLABOR Research Laboratory of Plastics Technology Co., Ltd.) with the setting temperature being 380° C. The thermoplastic resin composition was melt-extruded with an annular die and the resultant was cut to obtain a base layer for a seamless conductive belt. The thickness of the base layer for an electroconductive belt was 70 μm. The surface resistivity of the base layer was $5.0\times10^{11}\Omega/\square$.

Resin Material

PEEK: polyether ether ketone (trade name: VICTREX PEEK 381G, manufactured by Victrex)

CB2: acetylene black (trade name: DENKA BLACK, manufactured by DENKI KAGAKU KOGYO KABUSHIKI KAISHA)

<<Elastic Layer>>

The elastic layer to be used for the three-layered belt is described.

<Constituent Components of Elastic Layer>

Constituent components of the elastic layer to be used for the three-layered belt are described below.

(e) Perfluoroalkyl Sulfonic Acid Alkali Metal Salt or Perfluoroalkyl Sulfonimide Alkali Metal Salt;

In the present invention, it is preferred that the alkali metal salt be incorporated into the elastic layer, followed by application of the curable composition, and thus the alkali metal salt be caused to migrate to the curable composition side in drying. Therefore, it is preferred that, as an alkali metal ion-containing substance soluble in an organic solvent in the curable composition, in particular, 2-butanone or 4-methyl-2-pentanone as the component (d), at least one selected from a perfluoroalkyl sulfonic acid alkali metal salt and a perfluoroalkyl sulfonamide alkali metal salt be incorporated into the elastic layer.

As described above, specific examples of the perfluoroalkyl sulfonic acid alkali metal salt and the perfluoroalkyl sulfonimide alkali metal salt may include potassium perfluorobutanesulfonate (potassium nonafluorobutanesulfonate; $C_4F_9SO_3K$) and potassium N,N-bis(nonafluorobutanesulfonyl) imide $(C_4F_9SO_2)_2NK$).

(g) Rubber Composition

A rubber composition to be used for forming the elastic layer is not particularly limited as long as the rubber composition can contain the component (e) and the component (e) can migrate to the curable composition side, and any of various rubber compositions may be used. Specific examples thereof include a butadiene rubber, an isoprene rubber, a nitrile rubber, a chloroprene rubber, an ethylene-propylene rubber, a silicone rubber, and a urethane rubber. One kind of those rubbers may be used alone or two or more kinds thereof may be used as a mixture. Of those, it is preferred to use a liquid silicone rubber because it is important to impart appropriate low hardness and sufficient deformation recovery ability to the elastic layer. In particular, it is more preferred to use an addition reaction cross-linked type liquid silicone rubber for the reasons of excellent productivity such as satisfactory processability, high stability of dimensional accuracy, and no generation of a reaction by-product during a curing reaction.

In the elastic layer, any of the following various additives may be appropriately blended in such a range that desired performance is obtained: a nonconductive filler, a plasticizer, an electroconductive filler, and the like. Examples of the nonconductive filler include diatomaceous earth, quartz powder, dry silica, wet silica, an aluminosilicate, and calcium carbonate. Examples of the plasticizer include polydimethylsiloxane oil, diphenylsilanediol, trimethylsilanol, a phthalic acid derivative, and an adipic acid derivative. Examples of the conductive filler include: an electroconductive agent with electron conduction mechanism such as carbon black, graphite, or an electroconductive metal oxide; and an electroconductive agent with ion conduction mechanism such as an alkali metal salt or a quaternary ammonium salt.

<Production Method for Elastic Layer>

A production method for the elastic layer is not particularly limited, and molding methods suitable for various resins may be used. Examples thereof include cast molding and ring coating.

In Examples and Comparative Examples described later, the base layer was obtained by cast molding.

The blending ratios of materials for a silicone rubber are shown below. A silicone base polymer (molecular weight Mw=100,000, manufactured by Dow Corning Toray Co., Ltd.), carbon (DENKA BLACK manufactured by DENKI KAGAKU KOGYO KABUSHIKI KAISHA), and the component (e) were mixed and defoamed in a blending ratio described later through use of a planetary mixer for 30 minutes to obtain a silicone rubber base material. During molding, the following A liquid and B liquid are mixed in a ratio of 1:1 on a mass basis. The A liquid is obtained by adding 0.02 part by mass of an isopropyl alcohol solution (platinum content: 3% by mass) of chloroplatinic acid to 100 parts by mass of the silicone rubber base material and mixing the resultant. The B liquid is obtained by adding 1.5 parts by mass of organohydrogen polysiloxane (viscosity: 10 cps, SiH content: 1% by mass, manufactured by Dow Corning Toray Co., Ltd.) to 100 parts by mass of the silicone rubber base material and mixing the resultant.

The base layer obtained as described above was set on a cylindrical holding mold, and a cylindrical cast mold was set on the holding mold with a clearance of 300 μm, and the silicone rubber was injected thereto. Next, the silicone rubber was subjected to primarily curing in an oven at 200° C. for 30 minutes. The cast mold was removed, and the silicon rubber was subjected to secondary curing further at 200° C. for 4 hours. Thus an elastic layer made of a silicone rubber with a thickness of about 300 μm was formed on the base layer.

<<Production Method for Surface Layer>>

A production method for the surface layer is not particularly limited as described in the above-mentioned section of the application method. In Examples and Comparative Examples described later, dip coating was used.

The base layer and elastic layer obtained by the blow molding were fitted around an outer circumference of a cylindrical mold, and ends thereof were sealed. Then, the layers were soaked in a container filled with a curable composition together with the mold. The layers were pulled up so that the relative speed of the liquid surface of the curable composition and the base layer became a predetermined speed, with the result that a coat of the curable composition was formed on the surface of the base layer. A pull-up speed (relative speed of the liquid surface of the curable composition and the base layer), a solvent ratio of the curable composition, and the like are adjusted depending on the intended film thickness.

In Examples and Comparative Examples described later, the pull-up speed was adjusted to 10 to 50 mm/sec, with the result that the film thickness of the surface layer was about 3 μm. The curable composition was prepared in a composition ratio described later. After the coat was formed, the resultant was dried in an environment of 23° C. under a vacuum state for 1 minute. The drying temperature and drying time are appropriately adjusted based on a solvent kind, a solvent ratio, film thickness, and the like. Then, the coat was cured by being irradiated with ultraviolet light until an accumulated light quantity reached 600 mJ/cm$^2$ through use of a UV irradiator (trade name: UE06/81-3, manufactured by Eye Graphics Co., Ltd.). The cross-section of the obtained surface layer was observed with an electron microscope, and it was found that the thickness of the surface layer was 3 μm.

<<Electrophotographic Apparatus>>

Figure 3:
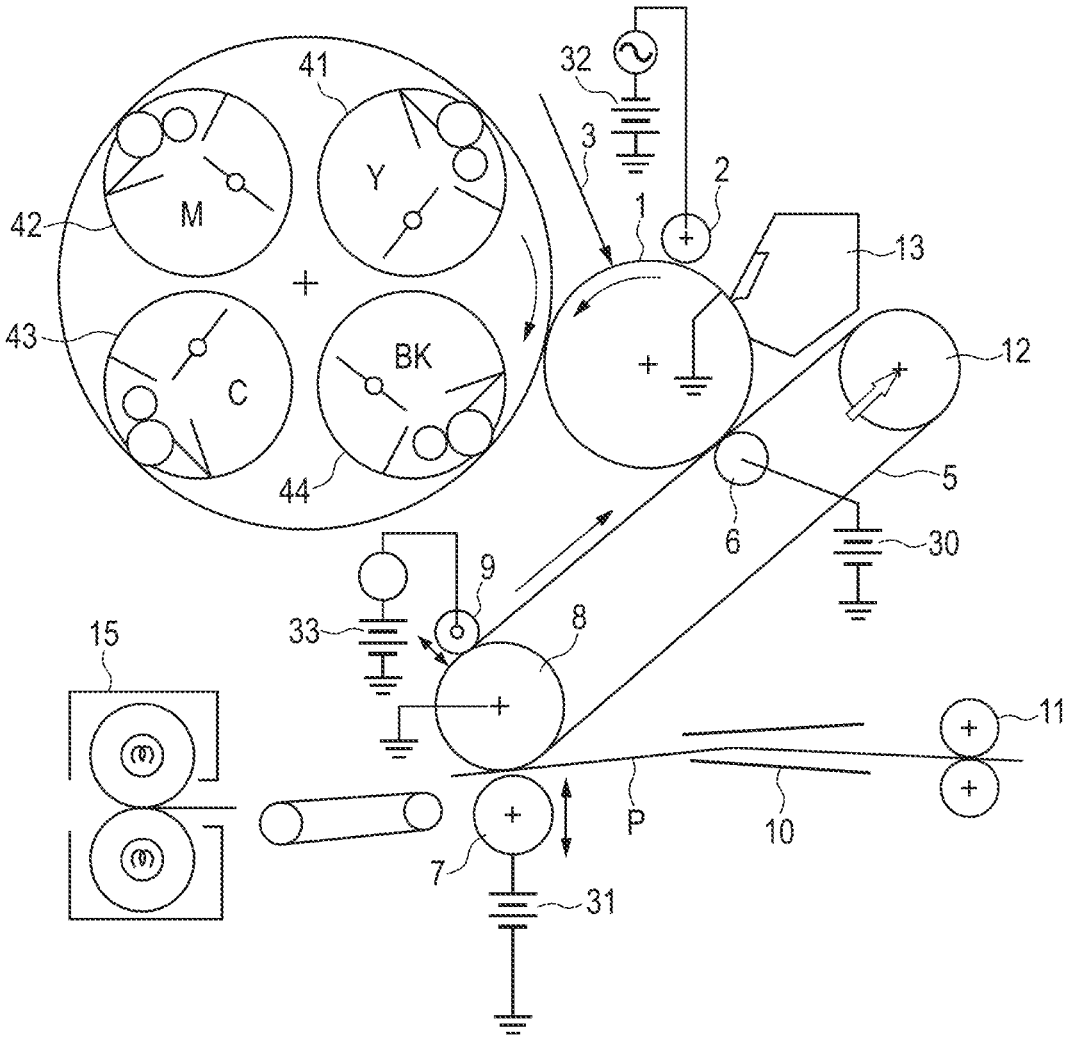
FIG. 3 is an explanatory diagram of an electrophotographic apparatus according to the present invention.

An electrophotographic apparatus according to the present invention is described. FIG. 3 is a sectional view of a full-color electrophotographic apparatus. In FIG. 3, a cylindrical seamless belt for electrophotography according to the present invention is used as an intermediate transfer belt 5.

An electrophotographic photosensitive member 1 is a drum-shaped electrophotographic photosensitive member (hereinafter referred to as "photosensitive drum") to be used repeatedly as a first image bearing member, and is rotated at a predetermined circumferential speed (process speed) in an arrow direction.

In the rotation process, the photosensitive drum 1 is uniformly charged to a predetermined polarity and potential by a primary charger 2. Then, the photosensitive drum receives image exposure 3 by exposure device, whereby an electrostatic latent image corresponding to a first color component image (for example, a yellow color component image) of an intended color image is formed. Note that, as the exposure device, for example, there are given a color separation and image formation exposure optical system of a color original image, a scanning exposure system with laser scanner for outputting a laser beam which is modulated corresponding to a time-series electric digital pixel signal of image information and the like.

Then, the electrostatic latent image on the photosensitive drum is developed with a yellow toner Y which is a first color by a first developing device (yellow color developing device 41). At this time, each of second to fourth developing devices (magenta color developing device 42, cyan color developing device 43, black color developing device 44) is not operated and does not act on the photosensitive drum 1. Thus, the first color yellow toner image is not influenced by the second to fourth developing devices. The belt for electrophotography 5 is rotated at the same circumferential speed as that of the photosensitive drum 1 in an arrow direction.

The yellow toner image on the photosensitive drum 1 is transferred onto an outer circumferential surface of the intermediate transfer belt 5 with an electric field formed by a primary transfer bias applied to the belt for electrophotography 5 through a primary transfer counter roller 6 from a power source 30 while passing through a nip portion between the photosensitive drum 1 and the intermediate transfer belt 5 (primary transfer). The surface of the photosensitive drum 1 after the first color yellow toner image has been transferred to the belt for electrophotography 5 is cleaned by a cleaning device 13.

Subsequently, a second color magenta toner image, a third color cyan toner image, and a fourth color black toner image are transferred onto the (intermediate transfer) belt for electrophotography 5 successively so as to be superimposed, with the result that a synthetic color toner image corresponding to an intended color image is formed. A secondary transfer roller 7 is provided in a lower surface portion of the belt for electrophotography 5 so as to be separated therefrom while being axially supported in parallel corresponding to a drive roller 8.

During the primary transfer step of the first to third color toner images from the photosensitive drum 1 to the belt for electrophotography 5, the secondary transfer roller 7 can also be separated from the belt for electrophotography 5. The synthetic color toner image transferred onto the belt for electrophotography 5 is transferred to a transfer material P serving as a second image bearing member as follows.

First, the secondary transfer roller 7 is brought into abutment with the belt for electrophotography 5, and the transfer material P is fed from sheet feed rollers 11 to an abutment nip between the belt for electrophotography 5 and the secondary transfer roller 7 through a transfer material guide 10 at a predetermined timing. Then, a secondary transfer bias is applied from the power source 31 to the secondary transfer roller 7. Owing to the secondary transfer bias, the synthetic color toner image is transferred from the (intermediate transfer) belt for electrophotography 5 to the transfer material P serving as a second image bearing member (secondary transfer).

The transfer material P having the toner image transferred thereto is introduced into a fixing device 15 where the toner image is fixed by heating on the transfer material P. After the completion of the image transfer to the transfer material P, an intermediate transfer belt cleaning roller 9 of the cleaning device is brought into abutment with the belt for electrophotography 5, and a bias with a polarity opposite to that of the photosensitive drum 1 is applied to the belt for electrophotography 5. Thus, a charge having a polarity opposite to that of the photosensitive drum 1 is applied to a toner (transfer residual toner) remaining on the belt for electrophotography 5 without being transferred to the transfer material P. A bias power source 33 is illustrated. The transfer residual toner is electrostatically transferred to the photosensitive drum 1 in the nip portion with respect to the photosensitive drum 1 and in the vicinity thereof, whereby the belt for electrophotography 5 is cleaned.

<<Evaluation Methods>>

<Roughness: Ten-Point Average Roughness Rzjis>

The ten-point average roughness Rzjis of the surface layer can be measured in conformity with JIS B 0601 (1994). The measurement was performed with a surface roughness meter "Surfcorder SE3500" manufactured by Kosaka Laboratory Ltd. The measurement conditions were as follows: scanning distance: 1.0 mm, cut-off value: 0.08 mm, probe scanning speed: 0.05 mm/sec.

<Adhesion to Other Members>

Figure 4:
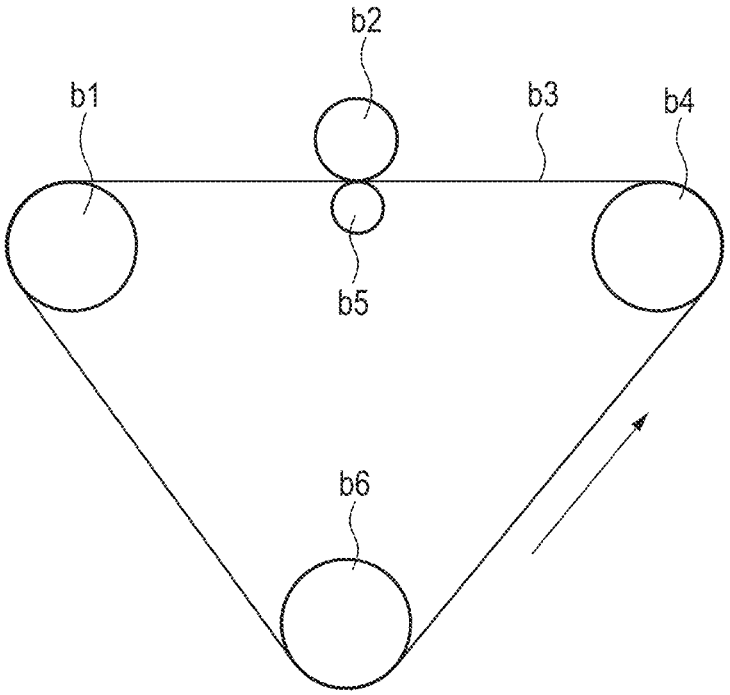
FIG. 4 is a schematic view of a jig for evaluating the adhesion of the belt for electrophotography according to the present invention with respect to other members.

The adhesion between the belt for electrophotography and a photosensitive drum of a full-color electrophotographic apparatus (trade name: LBP-5200, manufactured by Canon Inc.) was measured through use of a jig as illustrated in FIG. 4. A belt for electrophotography b3 is stretched by a drive roller b1 equipped with a motor and a torque meter, a driven roller b4, and a tension roller b6 which applies tension to the belt for electrophotography b3. As a photosensitive drum b2 and a backup roller b5, a photosensitive drum and a transfer roller of the LBP-5200 are respectively used.

The belt for electrophotography is rotated at 180 mm/sec while the photosensitive drum is not in contact with the belt for electrophotography, and a torque value at this time is measured. This value is defined as "Tq1".

Next, while the belt for electrophotography is rotated at 180 mm/sec, the maximum value of a torque is measured when the photosensitive drum is brought into contact with the belt for electrophotography at 700 gf. This value is defined to be "Tq2". Then, a difference between the "Tq2" and the "Tq1" is used as an index for evaluating the adhesion between the belt for electrophotography and the photosensitive drum. Then, in the case where the difference is 0.2 Nm or more, an evaluation rank is set to "B", and in the case where the difference is less than 0.2 Nm, an evaluation rank is set to "A".

The adhesion was evaluated in an initial stage and after endurance. For evaluation of the adhesion in initial stage, a new belt for electrophotography was used. The adhesion after endurance was measured after 50,000 electrophotographic images were formed by the full-color electrophotographic apparatus.

Further, the belt for electrophotography and the photosensitive drum are brought into contact with each other under the condition that the photosensitive drum is fixed without being rotated, and the contact surface of the photosensitive drum is made a fresh state without fail.

<Singular Point (Seediness)>

Positions of singular points (seediness) on the obtained belt for electrophotography were identified by visual inspection. Then, the number of the singular points (seediness) of 20 μm or more present on a surface layer was counted by observation with a microscope.

<Average Primary Particle Diameter>

In the present invention, the average primary particle diameters of inorganic oxide particles and conductive metal oxide particles in a surface layer were obtained by the following method.

Specifically, a sample was cut out from a surface layer of a belt for electrophotography with a microtome or the like, and a photograph of a cross-section of the sample in a thickness direction of the surface layer is taken through use of a transmission electron microscope (TEM). Further, the sample is subjected to elementary analysis by energy dispersive X-ray spectroscopy (EDX), and the inorganic oxide particles and conductive metal oxide particles forming heteroaggregates in the photograph obtained by the TEM were distinguished.

Then, from the above-mentioned photograph, a sum of a maximum length and a minimum length in a projected image of each of the inorganic oxide particles forming the heteroaggregates is divided by 2, and a value thus obtained is defined as a primary particle diameter of the inorganic oxide particle. This operation is performed for 100 inorganic oxide particles forming the heteroaggregates, and an arithmetic average value of the obtained primary particle diameters is defined as an average primary particle diameter of each of the inorganic oxide particles.

The conductive metal oxide particles forming the heteroaggregates are also subjected to the same operation to obtain respective primary particle diameters of 100 conductive metal oxide particles forming the heteroaggregates. An arithmetic average value thereof is defined as an average primary particle diameter of each of the conductive metal oxide particles.

EXAMPLES

The present invention is described in detail below by way of Examples and Comparative Examples. However, the scope of the present invention is not limited thereto.

Table 1 shows blending ratios of materials forming a base layer and an elastic layer. Table 2 shows blending ratios of materials forming a curable composition for forming a surface layer. Tables 3 and 4 show combinations of the base layer, elastic layer, and curable composition used in Examples and Comparative Examples, and evaluation results thereof.

TABLE 1

| | Base layer 1 | Base layer 2 | Base layer 3 | Base layer 4 | Base layer 5 | Base layer 6 | Elastic layer 7 | Elastic layer 1 | Elastic layer 2 |
|---|---|---|---|---|---|---|---|---|---|
| PEN | 84 | 83 | 82 | 82 | 82 | 82 | — | — | — |
| PEEA | 15 | 15 | 15 | 15 | 15 | 15 | — | — | — |
| CB1 *5 | 1 | 1 | 1 | 1 | 1 | 1 | — | — | — |
| PEEK | — | — | — | — | — | — | 81 | — | — |
| CB2 *6 | — | — | — | — | — | — | 19 | 10 | 10 |
| Liquid silicone rubber | — | — | — | — | — | — | — | 90 | 88 |
| Component (e) *1 | — | 1 | 2 | — | — | — | — | — | 2 |
| Component (e) *2 | — | — | — | 2 | — | — | — | — | — |

TABLE 1-continued

| | Base layer 1 | Base layer 2 | Base layer 3 | Base layer 4 | Base layer 5 | Base layer 6 | Elastic layer 7 | Elastic layer 1 | Elastic layer 2 |
|---|---|---|---|---|---|---|---|---|---|
| Component (e) *3 | — | — | — | — | 2 | — | — | — | — |
| Component (e) *4 | — | — | — | — | — | 2 | — | — | — |

Unit: part by mass

*1 "KFBS" manufactured by Mitsubishi Materials Electronic Chemicals Co., Ltd.; potassium perfluorobutanesulfonate

*2 "LFBS" manufactured by Mitsubishi Materials Electronic Chemicals Co., Ltd.; lithium perfluorobutanesulfonate

*3 bis(trifluoromethanesulfonyl)imide potassium salt manufactured by Mitsubishi Materials Electronic Chemicals Co., Ltd.

*4 bis(nonafluorobutanesulfonyl)imide potassium salt manufactured by Mitsubishi Materials Electronic Chemicals Co., Ltd.

*5 "MA-100" manufactured by Mitsubishi Chemical Corporation

*6 "DENKA BLACK" manufactured by DENKI KAGAKU KOGYO KABUSHIKI KAISHA

TABLE 2

| | | Curable composition | | | | | | | | | | |
|---|---|---|---|---|---|---|---|---|---|---|---|---|
| | | No. 1 | No. 2 | No. 3 | No. 4 | No. 5 | No. 6 | No. 7 | No. 8 | No. 9 | No. 10 | No. 11 |
| Component (a) | *1-1 | 8.33 | — | 100 | — | 8.33 | — | — | 8.33 | 4.17 | 11.67 | — |
| | *1-2 | — | — | — | 16.67 | — | 16.67 | — | — | — | — | — |
| | *1-3 | — | — | — | — | — | — | 25 | — | — | — | — |
| Component (b) | *2-1 | 75 | 75 | — | 75 | — | — | — | 75 | 25 | 100 | — |
| | *2-2 | — | — | — | — | 120 | 120 | — | — | — | — | — |
| | *2-3 | — | — | — | — | — | — | 150 | — | — | — | — |
| Component (c) | *3 | 57 | 57 | 57 | 57 | 57 | 57 | 57 | 57 | 57 | 57 | 57 |
| | *4 | 38 | 38 | 38 | 38 | 38 | 38 | 38 | 38 | 38 | 38 | 38 |
| Component (d) | 2-Butanone | 200 | 200 | 200 | 200 | 200 | 200 | 200 | 200 | 200 | 200 | 200 |
| | 4-Methyl-2-pentanone | 140 | 140 | 140 | 140 | 140 | 140 | 140 | 140 | 140 | 140 | 140 |
| Component (e) *5 | | — | — | — | — | — | — | — | 0.1 | — | — | — |
| Polymerization initiator *6 | | 5 | 5 | 5 | 5 | 5 | 5 | 5 | 5 | 5 | 5 | 5 |
| Leveling agent *7 | | 0.5 | 0.5 | 0.5 | 0.5 | 0.5 | 0.5 | 0.5 | 0.5 | 0.5 | 0.5 | 0.5 |
| Resin particle *8 | | — | — | — | — | — | — | — | — | — | — | 5 |

Unit: part by mass

*1-1 "SNOWTEX MEK-ST" manufactured by NISSAN CHEMICAL INDUSTRIES. LTD.; silica particle slurry (30 mass % in terms of silica particle component),

*1-2 "Nano Tek Slurry" manufactured by C.I. KASEI CO., LTD.; titania particle slurry (15 mass % in terms of titania particle component),

*1-3 "Nano Tek Slurry" manufactured by C.I. KASEI CO., LTD.; yttrium oxide particle slurry (10 mass % in terms of yttrium oxide particle component),

*2-1 "CELNAX CX-Z400K" manufactured by NISSAN CHEMICAL INDUSTRIES. LTD.; zinc antimonite particle slurry (40 mass % in terms of zinc antimonate particle component),

*2-2 "GZOMIBK-E12" manufactured by C.I. KASEI CO., LTD.; gallium-doped zinc oxide particle slurry (25 mass % in terms of gallium-doped zinc oxide particle component),

*2-3 "ATO(T-1)" manufactured by Mitsubishi Materials Electronic Chemicals Co., Ltd.; antimony-doped tin oxide particle slurry (20 mass % in terms of antimony-doped tin oxide particle component),

*3 "ARONIX M-402" manufactured by TOAGOSEI CO., LTD.; dipentaerythritol pentaacrylate and dipentaerythritol hexaacrylate,

*4 "ARONIX M-305" manufactured by TOAGOSEI CO., LTD.; pentaerythritol triacrylate and pentaerythritol tetraacrylate,

*5 "KFBS" manufactured by Mitsubishi Materials Electronic Chemicals Co., Ltd.; potassium perfluorobutanesulfonate,

*6 "IRGACURE 907" manufactured by BASF,

*7 "BYK-Silclean 3700" manufactured by BYK,

*8 "EPOSTAR S12" manufactured by NIPPON SHOKUBAI CO., LTD.; particle diameter: 1 to 2 μm.

TABLE 3

| | Example | | | | | | |
|---|---|---|---|---|---|---|---|
| | 1 | 2 | 3 | 4 | 5 | 6 | 7 |
| Base layer or base layer and elastic layer | Base layer 2 | Base layer 3 | Base layer 4 | Base layer 5 | Base layer 6 | Base layer 3 | Base layer 3 |
| Curable composition | Curable composition 1 | Curable composition 1 | Curable composition 1 | Curable composition 1 | Curable composition 1 | Curable composition 4 | Curable composition 5 |
| Component (e) in base layer or elastic layer | Present | Present | Present | Present | Present | Present | Present |
| Component (a) in curable composition | Present | Present | Present | Present | Present | Present | Present |
| Component (b) in curable composition | Present | Present | Present | Present | Present | Present | Present |
| Roughness Rzjis (μm) | 0.40 | 0.63 | 0.53 | 0.58 | 0.55 | 0.65 | 0.62 |

TABLE 3-continued

| | | | | | | | |
|---|---|---|---|---|---|---|---|
| Adhesion to other members (initial) | A | A | A | A | A | A | A |
| Adhesion to other members (after endurance) | A | A | A | A | A | A | A |
| Average primary particle diameter of component (a) (nm) | 20 | 20 | 20 | 20 | 20 | 16 | 20 |
| Average primary particle diameter of component (b) (nm) | 20 | 20 | 21 | 20 | 20 | 20 | 21 |
| Number of singular points (seediness) (pieces) | 0 | 1 | 1 | 1 | 0 | 2 | 2 |

| | Example | | | | | |
|---|---|---|---|---|---|---|
| | 8 | 9 | 10 | 11 | 12 | 13 |
| Base layer or base layer and elastic layer | Base layer 3 | Base layer 3 | Base layer 2 | Base layer 3 | Base layer 3 | Base layer 7 Elastic layer 2 |
| Curable composition | Curable composition 6 | Curable composition 7 | Curable composition 8 | Curable composition 9 | Curable composition 10 | Curable composition 1 |
| Component (e) in base layer or elastic layer | Present | Present | Present | Present | Present | Present |
| Component (a) in curable composition | Present | Present | Present | Present | Present | Present |
| Component (b) in curable composition | Present | Present | Present | Present | Present | Present |
| Roughness Rzjis (μm) | 0.63 | 0.62 | 0.65 | 0.30 | 0.70 | 0.41 |
| Adhesion to other members (initial) | A | A | A | A | A | A |
| Adhesion to other members (after endurance) | A | A | A | A | A | A |
| Average primary particle diameter of component (a) (nm) | 16 | 18 | 20 | 20 | 20 | 20 |
| Average primary particle diameter of component (b) (nm) | 21 | 27 | 20 | 20 | 20 | 20 |
| Number of singular points (seediness) (pieces) | 3 | 3 | 1 | 1 | 0 | 0 |

TABLE 4

| | Comparative Example | | | | |
|---|---|---|---|---|---|
| | 1 | 2 | 3 | 4 | 5 |
| Base layer or base layer and elastic layer | Base layer 1 | Base layer 3 | Base layer 3 | Base layer 3 | Base layer 7 Elastic layer 1 |
| Curable composition | Curable composition 1 | Curable composition 2 | Curable composition 3 | Curable composition 11 | Curable composition 1 |
| Component (e) in base layer or elastic layer | Absent | Present | Present | Present | Absent |
| Component (a) in curable composition | Present | Absent | Present | Absent | Present |
| Component (b) in curable composition | Present | Present | Absent | Absent | Present |
| Roughness Rzjis (μm) | 0.09 | 0.10 | 0.04 | 0.70 | 0.09 |
| Adhesion to other members (initial) | B | A | B | A | B |

TABLE 4-continued

| | Comparative Example | | | | |
|---|---|---|---|---|---|
| | 1 | 2 | 3 | 4 | 5 |
| Adhesion to other members (after endurance) | B | B | B | A | B |
| Average primary particle diameter of component (a) (nm) | 20 | — | 20 | — | 20 |
| Average primary particle diameter of component (b) (nm) | 21 | 20 | — | — | 20 |
| Number of singular points (seediness) (pieces) | 1 | 1 | 0 | 85 | 1 |

Examples 1 to 9

The belts for electrophotography according to Examples 1 to 9 each had a surface roughened to a surface roughness Rzjis of from 0.3 to 0.7 μm by remarkable heteroaggregation caused by the above-mentioned mechanism owing to the presence of the component (e) in the base layer and the component (a) and the component (b) in the curable composition.

Further, the adhesion to the other members was low both in an initial stage and after endurance, and the number of singular points (seediness) was small.

The average primary particle diameters of the inorganic oxide particles and the conductive metal oxide particles forming the heteroaggregates were as shown in Table 3 above.

Example 10

The belt for electrophotography according to Example 10 had a surface roughened to a surface roughness Rzjis of 0.65 μm by remarkable heteroaggregation caused by the above-mentioned mechanism owing to the presence of the component (e) in the base layer and the component (a) and the component (b) in the curable composition.

Further, the adhesion to the other members was low both in an initial stage and after endurance, and the number of singular points (seediness) was small.

The average primary particle diameters of the inorganic oxide (silica) particles and the conductive metal oxide (zinc antimonate) particles forming the heteroaggregates were as shown Table 3 above.

In this example, the roughness of the surface layer was larger than that of Example 1 owing to the auxiliary addition of the component (e) to the curable composition 8.

Example 11

The belt for electrophotography according to Example 11 had a surface roughened to a surface roughness Rzjis of 0.30 μm by remarkable heteroaggregation caused by the above-mentioned mechanism owing to the presence of the component (e) in the base layer and the component (a) and the component (b) in the curable composition.

Further, the adhesion to the other members was low both in an initial stage and after endurance, and the number of singular points (seediness) was small.

The average primary particle diameters of the inorganic oxide (silica) particles and the conductive metal oxide (zinc antimonate) particles forming the heteroaggregates were as shown Table 3 above.

In this example, the addition amounts of the component (a) and the component (b) in the curable composition were reduced, compared to those of Examples 1 to 10, and the roughness Rzjis of the surface layer was 0.3 μm.

Example 12

The belt for electrophotography according to Example 12 had a surface roughened to a surface roughness Rzjis of 0.70 μm by remarkable heteroaggregation caused by the above-mentioned mechanism owing to the presence of the component (e) in the base layer and the component (a) and the component (b) in the curable composition.

Further, the adhesion to the other members was low both in an initial stage and after endurance, and the number of singular points (seediness) was small.

The average primary particle diameters of the inorganic oxide (silica) particles and the conductive metal oxide (zinc antimonate) particles forming the heteroaggregates were as shown in Table 3 above.

In this example, the addition amounts of the component (a) and the component (b) in the curable composition were increased, compared to those of Examples 1 to 10, and the roughness Rzjis of the surface layer was 0.7 μm.

Example 13

The belt for electrophotography according to Example 13 had a surface roughened to a surface roughness Rzjis of 0.41 μm by remarkable heteroaggregation caused by the above-mentioned mechanism owing to the presence of the component (e) in the elastic layer and the component (a) and the component (b) in the curable composition.

Further, the adhesion to the other members was low both in an initial stage and after endurance, and the number of singular points (seediness) was small.

The average primary particle diameters of the inorganic oxide particles and the conductive metal oxide particles forming the heteroaggregates were as shown in Table 3 above.

Comparative Example 1

The component (e) in the base layer was not present, and hence remarkable heteroaggregation caused by the above-mentioned mechanism was not formed in the formation step of a surface layer. Therefore, a predetermined roughness was not formed on the surface of the belt for electrophotography according to this comparative example. As a result, the belt for electrophotography according to this comparative example had high adhesion to the other members.

Comparative Example 2

The component (a) was not contained in the curable composition for forming a surface layer, and hence remarkable heteroaggregation caused by the above-mentioned mechanism was not formed in the formation step of a surface layer. Therefore, a predetermined roughness was not formed on the surface of the belt for electrophotography according to this comparative example. As a result, the belt for electrophotography according to this comparative example after endurance had high adhesion to the other members.

Comparative Example 3

The component (b) was not contained in the curable composition for forming a surface layer, and hence remarkable heteroaggregation caused by the above-mentioned mechanism was not formed in the formation step of a surface layer. Therefore, a predetermined roughness was not formed on the surface of the belt for electrophotography according to this comparative example. As a result, the belt for electrophotography according to this comparative example in an initial stage and after endurance had high adhesion to the other members.

It is understood from the results of Comparative Examples 1 to 3 that, when any one of the component (e) in the base layer and the components (a) and (b) in the curable composition is not present, roughness is not formed on the surface layer because remarkable heteroaggregation caused by the above-mentioned mechanism is not formed. As in Examples above, remarkable heteroaggregation caused by the above-mentioned mechanism is formed only when the three components are present, and thus roughness is formed on the surface layer.

Comparative Example 4

In the belt for electrophotography according to this comparative example, organic resin fine particles each having a particle diameter of 1 to 2 μm were added to a curable composition, and hence a predetermined roughness was formed on the surface. Therefore, the adhesion of the belt for electrophotography according to this comparative example with respect to the other members was low both in an initial stage and after endurance.

However, the surface was roughened through use of particles each having a large particle diameter, therefore, the number of singular points (seediness) was large, and a great number of dot-shaped image defects occurred in an electrophotographic image formed through use of an image forming apparatus incorporating the belt for electrophotography according to this comparative example.

Comparative Example 5

The component (e) in the elastic layer was not present, and hence remarkable heteroaggregation caused by the above-mentioned mechanism was not formed in the formation step of a surface layer. Therefore, a predetermined roughness was not formed on the surface of the belt for electrophotography according to this comparative example. As a result, the belt for electrophotography according to this comparative example had high adhesion to the other members.

Note that the particle diameter of each of the silica particles in the curable composition measured by a dynamic light scattering method fell within the range of 10 to 20 nm, and that of each of the zinc antimonate particles fell within the range of 110 to 140 nm. The measurement was performed with "FPIR-1000" manufactured by Otsuka Electronics Co., Ltd.

REFERENCE SIGNS LIST a1 base layer
a2 surface layer
1 photosensitive drum
2 primary charger
3 image exposure
5 intermediate transfer belt
6 primary transfer counter roller
7 secondary transfer roller
8 drive roller
9 intermediate transfer belt cleaning roller
10 transfer material guide
11 sheet feed roller
13 cleaning device
15 fixing device
30, 31, 33 power source
104 preform
107 heating unit
108 blow mold
109 stretching rod
110 blow air injection portion
112 bottle-shaped molding
114 air
b1 drive roller
b2 photosensitive drum
b3 belt for electrophotography
b4 driven roller
b5 backup roller
b6 tension roller While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-000192, filed on Jan. 4, 2013, which is hereby incorporated by reference herein in its entirety.

What is claimed is:

1. A belt for electrophotography,
comprising:
a base layer; and
a surface layer provided on the base layer
or comprising:
a base layer;
an elastic layer provided on the base layer; and
a surface layer provided on the elastic layer,
wherein:
the surface layer comprises heteroaggregate comprising
an inorganic oxide particle having an average primary particle diameter of from 10 to 30 nm, and
an electroconductive metal oxide particle having an average primary particle diameter of from 5 to 40 nm,
the electroconductive metal oxide particle being different from the inorganic oxide particle; and wherein:

a ten-point average roughness Rzjis of a surface of the surface layer satisfies a relationship:

$$0.3\ \mu m \leq Rzjis \leq 0.7\ \mu m.$$

2. The belt for electrophotography according to claim 1, wherein the inorganic oxide particle comprises a silica particle and the electroconductive metal oxide particle comprises a zinc antimonate particle.

3. The belt for electrophotography according to claim 1, wherein the surface layer has a protruded portion derived from the heteroaggregate on the surface thereof.

4. The belt for electrophotography according to claim 1, wherein the surface layer comprises an alkali metal ion.

5. A production method for a belt for electrophotography, comprising:

a base layer; and a surface layer provide on the base layer or comprising:

a base layer;

an elastic layer provided on the base layer; and a surface layer provided on the elastic layer, the production method comprising:

applying a curable composition containing the following components (a) to (d) on the base layer or on the elastic layer each containing the following component (e); and curing the curable composition and forming the surface layer:

(a) an alkyl group-modified inorganic oxide particle having an average primary particle diameter of from 10 to 30 nm;

(b) an electroconductive metal oxide particle having an average primary particle diameter of from 5 to 40 nm treated with an alkylamine;

(c) an acrylic monomer;

(d) 2-butanone or 4-methyl-2-pentanone; and (e) a perfluoroalkyl sulfonic acid alkali metal salt or a perfluoroalkyl sulfonimide alkali metal salt.

6. An electrophotographic apparatus, comprising the belt for electrophotography according to claim 1 as an intermediate transfer belt.

* * * * *